United States Patent [19]

Margetts

[11] Patent Number: 4,913,371

[45] Date of Patent: Apr. 3, 1990

[54] AUTOMATIC RESET STRAP LOCK DEVICE

[76] Inventor: H. Russell Margetts, 3093 S. 2600 East, Salt Lake City, Utah 84109

[21] Appl. No.: 242,642

[22] Filed: Sep. 12, 1988

[51] Int. Cl.[4] ..... B65H 75/48; F16D 63/00

[52] U.S. Cl. ..... 242/107.4 B; 188/82.77

[58] Field of Search ..... 242/107.4 R, 107.4 B, 242/107.4 C; 188/82.77, 135, 139

[56] References Cited

U.S. PATENT DOCUMENTS

| | | | |
|---|---|---|---|
| 2,801,814 | 8/1957 | Fischer et al. | 242/107.4 R |
| 2,990,131 | 6/1961 | Carlsson | 242/107.4 B |
| 3,421,605 | 1/1969 | Hansen | 242/107.4 BX |
| 4,083,512 | 4/1978 | Rumpf | 242/107.4 BX |
| 4,177,962 | 12/1979 | Hildebrandt | 242/107.4 B |
| 4,293,106 | 10/1981 | Standing | 242/107.4 BX |

*Primary Examiner*—Stanley N. Gilreath
*Assistant Examiner*—E. Dunlap
*Attorney, Agent, or Firm*—M. Reid Russell

[57] ABSTRACT

An automatic reset strap lock device having pawls to engage lugs upon rapid pulling of a strap from a drum on which the strap is wound and springs and an inertia plate to insure resetting of the pawls to permit rewinding of the strap or continued pulling of the strap from the drum at a rate that does not actuate the pawls into engagement with the lugs.

4 Claims, 1 Drawing Sheet

AUTOMATIC RESET STRAP LOCK DEVICE

BRIEF DESCRIPTION OF THE INVENTION

1. Field of the Invention

This invention relates to automatic strap locks and is particularly concerned with support straps for suspended, pivotally mounted basketball standards and other hanging devices.

2. Prior Art

In order to provide for maximum use of gymnasium facilities in schools and other recreation centers the basketball backboards are often mounted to be pivoted from a use position to a raised storage position. Commonly, cables are used to move the backboards from use to storage and position. The cables are wound on a take-up reel either manually with a crank or by motor. In any event there is a possibility that the mechanism used will fail and that the backboard will freely swing to its lowered position.

It is also common to have collaspsible bleachers that pull out of a wall for use and that push back into the wall for storage. In many cases the pivoted backboards are positioned over the bleachers and fall while people are sitting in the bleachers. It is not uncommon for serious injuries to occur to people struck by the falling backboards.

In order to prevent the possibility of injury to persons beneath a falling backboard various types of safety systems have been proposed. Generally, such systems have involved the use of a positive locking device to hold the backstop in its raised position. An attendant then must climb on a high ladder to reach the lock to latch or unlatch it, as desired, or the attendant may use a long pole with a hook on the end to manipulate the lock. The use of the high ladder raises another safety consideration and reliance on an attendant to perform the functions is not always satisfactory since the safety latching may not be accomplished.

Other safety devices presently used are centrifugally actuated but are triggered like a gun and after each action must be manually reset. Furthermore, these known devices will trigger not only in an emergency situation but also when a stray basketball or the like hits the extended belts of the devices. No matter how the devices are triggered they must then be reset manually with the use of ladders or scaffolding or by climbing out on a beam to the location of the safety device. Safety devices of this type, requiring manual reset are sold under the trade names "FULL CYCLE SAFETY BELT" for "E-Z-FOLD" and "SAFSTOP".

OBJECTS OF THE INVENTION

Principal objects of the present invention are to provide a safety mechanism that will allow for normal raising and lowering of a pivoted basketball backboard, but that will prevent inadvertent release and falling of the backboard.

Still other objects are to provide a safety mechanism in the form of an automatic strap lock that is economical to produce, positive in locking of a strap that is connected between a take-up assembly mounted to a support structure and the backboard.

Another object is to provide an automatic strap lock that is responsive to accelerated strap release and to lock the strap to prevent continued backboard travel and that automatically retrieves the strap as the backboard is raised and automatically resets to again be ready to lock the strap in the event of accelerated strap release, without additional attention.

Yet another object is to provide a strap lock that is automatically reset regardless of how the device is initially actuated, i.e., whether resulting from an emergency situation or from hitting of the strap of the device with a basketball or the like.

FEATURES OF THE INVENTION

Principal features of the invention include a spring wound drum to which one end of a strap is connected and on which the strap is adapted to be wound.

A housing for the drum has a plurality of lugs and cam surfaces spaced around a side wall thereof and a plurality of centrifugally operated pawls pivotally mounted on the drum are thrown outwardly to engage the lugs and to prevent further rotation of the drum and continued release of the strap.

A heavy inertia plate is centrally pivoted on the drum and has diagonal slots serving as guide means into which pins from a spring loaded actuating arm are inserted. Any sudden speed change of the drum causes the inertia plate to rotate from a starting position and to move the pawls into the lugs, thereby locking the drum. The pawls are then set either by centrifugal force, caused by an increased speed of the drum, or by the inertia plate responding to any sudden increased action of the drum. After any setting action of the drum, relaxing of the applied pressure will release the locking mechanism so the safety device is automatically again ready for use. A spring biases the inertia plate back to its starting position and during such movement the engagement of the diagonal slots with the pins assist in moving the pawls.

The housing has a support structure projecting from a top thereof and the belt is released and retracted through an opening provided in the bottom of the housing.

A steady pull on the belt will release the belt as the drum is turned. However, a rapid acceleration of the belt travel and rotation of the drum will cause the pivoted pawls to overcome the biasing effect of the spring loaded return members. The pawls are then thrown outwardly to engage the shoulders and to prevent further rotation of the drum and continued release of the belt.

Relaxation of the pulling force on the belt will allow the pawls to be reset as they travel over the cam surface and are positioned by the guide means in the weight and the spring loaded return members.

Other objects and features of the invention will become apparent from the following detailed description and drawing disclosing what are presently contemplated as being the best modes of the invention.

THE DRAWING

In the drawings:

FIG. 1 is a front elevation view of the automatic strap lock of the invention;

FIG. 2, a vertical sectional view taken on the line 2—2 of FIG. 1, with parts broken away for clarity;

FIG. 3, a vertical section view, taken on the line 3—3 of FIG. 2; and

FIG. 4, a perspective view of the automatic strap lock with a hanger assembly attached thereto.

DETAILED DESCRIPTION

Figure 1:
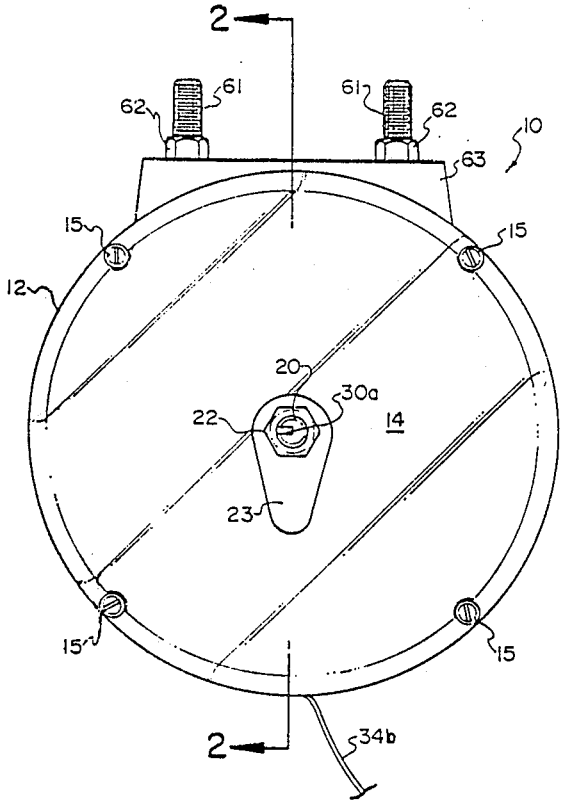
Figure 2:
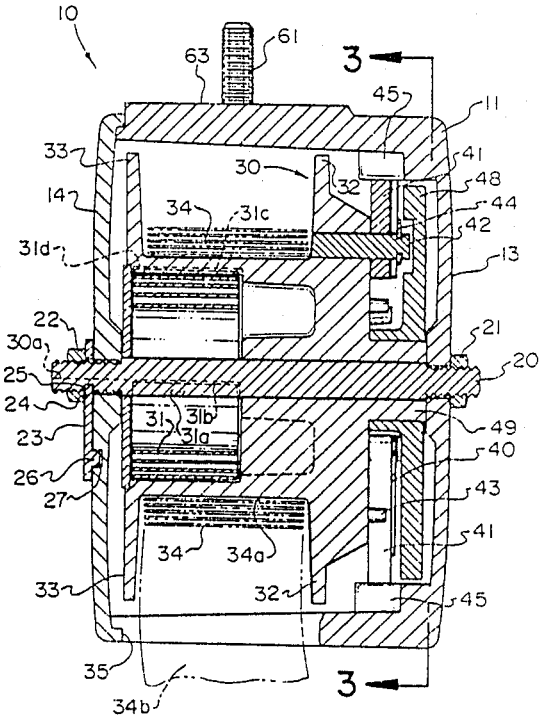
Figure 3:
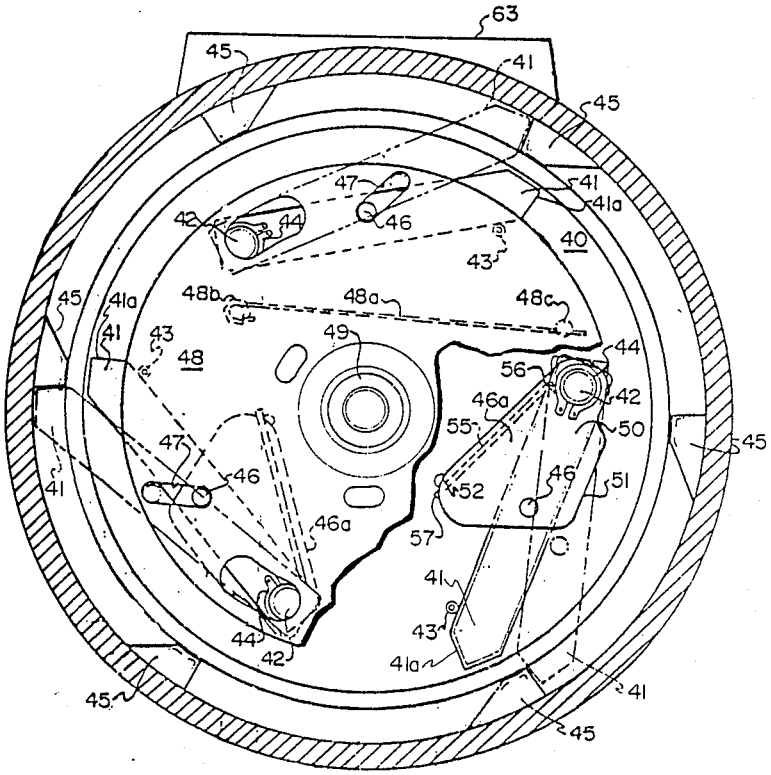
Figure 4:
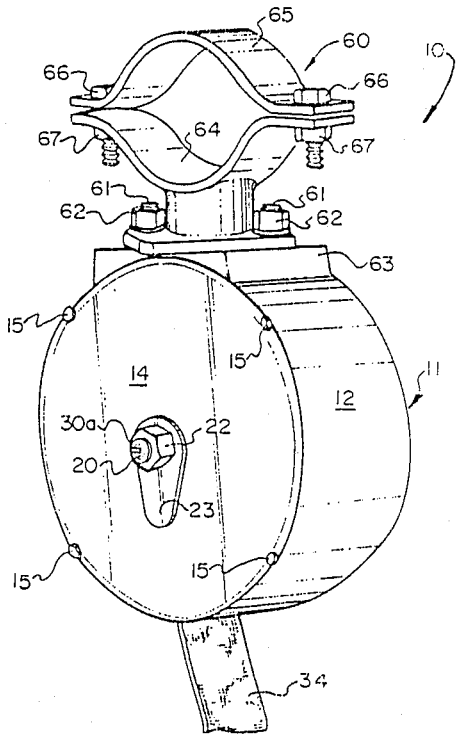

Referring now to the drawings:

In the illustrated preferred embodiment, the automatic strap lock unit of the invention is shown generally at 10.

The unit 10 includes a housing 11 with an integral circular side wall 12 and back wall 13 and a removable front cover 14. The front cover is secured to the side wall by bolts 15 spaced around the outer edge of the cover and threaded into the side wall.

An axle shaft 20 extends through the rearwall 13 of housing 11 and through the front cover 14, and is secured by nuts 21 and 22, respectively threaded onto opposite ends of the shaft.

A spring arm 23 has one end fitted over the shaft 20 and a finger 24 that extends into a hole 25 provided therefor in the shaft. An opposite end of the arm 23 has a finger 26 projecting therefrom to snap into a hole 27 provided in the cover 14. When nuts 21 and 22 are loosened finger 26 can be removed from hole 27 and the finger 26 can be turned to rotate the shaft 20.

A drum 30 is journaled on the shaft 20 and a coil spring 31 fits in a cavity **30*a* of the drum. One end of the spring is inserted into a groove 31*b* in the shaft 20 and the other end 31*c* is inserted into a groove 31*d* in the drum. Thus, when the drum 20 is held and finger 26 is removed from hole 27 the arm 23 can be used to turn the shaft 20 to wind the spring 31 thereon or to release the spring, as may be required for safe disassembly of the unit 10**.

Drum 30 also has a pair of spaced apart flanges 32 and 33 with a flat strap 34 wrapped therearound. One end **34*a* of the strap is secured to the drum and the other free end 34*b* extends through a bottom opening 35 in the side wall 12 of housing 11**.

A drum face 40 is provided on the flange 32 and has a plurality of elongate pawls 41, each of which has one end pivotally mounted on a post 42 projecting from the drum face. Each pawl 41 has a pointed end **41*a* and engages a stop pin 43 projecting from the face 40 to limit swinging of the pawl. A snap ring 44, snapped into a groove encircling the post 42 holds each pawl on its post. When the pawls are against their stop pins 43 during rotation of the drum 30 the drum can freely rotate within the housing 11**.

The inside surface of side wall 12 has a plurality of lugs 45 equally spaced around the housing and arranged to be engaged by the ends **41*a* of pawls 41 when the pawls swing outwardly away from their associated pins 43**.

Each pawl 41 has a guide pin 46 projecting from an assist member **46*a* and each guide pin extends into a slot 47 provided therefore through a flat circular heavily weighted inertia plate 48 that is journaled around a central hub 49 projecting from the drum face 40. A spring 48*a* has one end 48*b* anchored to the drum face 40 and its other end 48*c* anchored to the inertia plate 48**.

The slots 47 are angled such that rotation of the inertia plate 48 relative to the drum face 40 and against the bias of spring **48*a* will act on the pins 46 to cam the pawls 41 outwardly away from their associated stop pins 43. When the pawls 41 are against their associated stop pins 43 the guide pins are at the inner ends of slots 47 and, as the guide pins move to the other ends of the slots, the pawls are pivoted outwardly such that the points 41*a* thereof will engage the lugs 45. The points 41*a* will remain in engagement with the lugs 45 and the drum will be secured against further rotation and release of additional strap 34 so long as a pulling force is applied to strap 34. If the pulling force is released, however, the spring 31 will turn the drum to wind the strap back onto the drum. In this event, the drum begins to rotate in a take-up direction and spring loaded inertia plate 48 is also turned as the guide pins 46 engage the edges of slots. Once the inertia member begins to turn it biases each pawl from its outwardly extended position towards its retracted position. Also, as the drum moves in its wind-up position the pawls engage cam guides formed as a continuation of each lug 45**.

Each spring loaded assist member **46*a* comprises a plate 50 having a hook 51 to engage an outer edge of a pawl 41, a guide pin 46 projecting from a face of the plate 50 and finger 52 extending from an inner edge of the plate 50 and extending over an inner edge of the lug. A spring 55 has one end 56 anchored in a hole provided therefore in the pawl 41 adjacent to the pivot pin 42. The other end 57 of the spring 55 extends between the pawl 41 and finger 52 and biases the finger 52 away from pawl 41 and hook 51** into engagement with the pawl.

The pawls 41 are simultaneously actuated either by inertial action of inertia plate 48 or by the centrifugal force of the pawls 50 and their cantileved weight turning around pinit pins 42. In either case the pawls 41 are syncronized by the inertia plate. The spring action of each assist member **46*a*** also allows one or more of the pawls to engage lugs in case the others may miss, thus preventing damage to the mechanism because of the great pressure exerted by an applied load.

A hanger assembly 60 is secured by bolts 61 and nuts 62 to a boss 63 formed on a top portion of the side wall 12 of housing 11. As shown, the hanger assembly includes a bottom clamp member 64 and a top clamp member 65 and bolts 66 and nuts 67 securing the clamp members together with a space between them.

In use with a basketball backboard the nuts 67 are threaded onto bolts 66 with a building structural support member (not shown) secured between the clamp members 64 and 65 and with the housing 11 suspended from the support member. The strap end is then attached to the lower back of the basketball backboard in any convenient fashion. Often such attachment is made by wrapping the strap end around a brace on the backboard and then securing the turned end of the strap to an intermediate strap portion with a strap clamp, not shown.

When the basketball backboard is pivoted to its raised position and the strap is attached the strap is in its retracted condition and is wound on the drum. If the backboard is lowered slowly — or at such steady normal rate as may be permitted by a cable and winch or other mechanism used, the strap 31 is played out and the drum 30 freely rotates. If, however, the strap travel and rotation of the drum accelerate rapidly the pawls 41 are moved from their positions resting against stop pins 43 outwardly until they engage lugs 45, as previously described. Thus, if the backboard to which the strap 31 is attached should begin to drop rapidly and out of control the unit 10 would prevent continued backboard travel and would prevent possible injury to persons beneath the backboard. The locking action of the strap, preventing further backboard travel, is easily released, merely by taking the load off the strap by operating the control winch of the cable suspending the backboard to pull the backboard towards its raised position. Thereafter, the backboard can again be slowly lowered or it can be raised, with the spring 31 acting to cause the drum 30 to rotate and takeup the strap 34.

If the backboard is in its fully raised or an intermediate position and the strap 31 is struck by a basketball or the like the impact may cause the strap to suddenly pull from the drum with a resultant actuation of the pawls 41 to engage lugs 45. However, immediately after the impact the pawls will return to their positions resting against stop pins 43 and the device has been automatically reset.

Although a preferred form of my invention has been herein disclosed, it is to be understood that the present disclosure is by way of example and that variations are possible without departing from the subject matter coming within the scope of the following claims, which subject matter I regard as my invention.

I claim:

1. An automatic strap lock comprising a housing having a circular side wall with a top and bottom having an opening therethrough, a rear wall, a back plate and a removable front plate;

an axle shaft extending through the front and back plates;

a drum in the housing journalled on the axle shaft and having a face plate with a hub projecting therefrom;

a strap having one end fixed to the drum and another end extending through the opening through the bottom of the circular side wall;

a coil spring having one end fixed to the drum and another end fixed to the axle shaft;

lugs spaced around the interior of the side wall;

at least one elongate pawl pivotally mounted on a pivot pin to the face plate of the drum and pivotal into and out of engagement with the lugs said pawls each having an outside edge comprising an elongate edge thereof closest to the lugs and an inside elongate edge thereof closest to the axle shaft;

a spring loaded return member on each pawl, said member including a plate having a top surface and pivoted on the pivot pin of the pawl, a first finger extending from the plate to alongside the outside edge of the pawl, a second finger extending from the plate to alongside the inside edge of the pawl, and a spring having one end fixed to the pawl adjacent the pivot pin therefor and another end engaging the second finger of the plate, and a pin projecting from the top surface of the plate a spaced distance from the pivot pin for the pawl;

a circular inertia plate journalled on the hub of the drum and having angled slots therethrough to receive each pin projecting from the plate of the spring loaded return member; and support means fixed to the top of the side wall for securing said lock to a structure.

2. An automatic strap lock as in claim 1, including a plurality of pawls spaced around the face of the drum.

3. An automatic strap lock as in claim 1, further including a stop pin projecting from the face plate of the drum for each pawl and positioned to limit travel of said pawl out of pawl engaging position.

4. An automatic strap lock as in claim 1, further including a cam guide extending from each lug whereby when the drum is rotated to take up the strap the cam guide moves each pawl out of pawl engaging position.

* * * * *